US005641730A

United States Patent [19]

Brown

[11] Patent Number: 5,641,730

[45] Date of Patent: Jun. 24, 1997

[54] GREASE COMPOSITION WITH IMPROVED ANTIWEAR PROPERTIES

[75] Inventor: Stuart H. Brown, San Rafael, Calif.

[73] Assignee: Chevron Chemical Company

[21] Appl. No.: 564,459

[22] Filed: Nov. 29, 1995

[51] Int. Cl.[6] ..... C10M 125/26; C10M 135/36

[52] U.S. Cl. ..... 508/156; 508/273; 508/274

[58] Field of Search ..... 252/47, 47.5, 46.3, 252/49.6; 508/156, 273, 274; C10M 125/26, 135/36

[56] References Cited

U.S. PATENT DOCUMENTS

| | | | |
|---|---|---|---|
| 2,197,263 | 4/1940 | Carmichael et al. | 87/9 |
| 2,564,561 | 8/1951 | Carmichael et al. . | |
| 2,999,066 | 9/1961 | Liddy . | |
| 3,313,727 | 4/1967 | Peeler . | |
| 3,663,561 | 5/1972 | Blaha | 252/47 |
| 3,819,521 | 6/1974 | Sims . | |
| 3,853,772 | 12/1974 | Adams . | |
| 3,907,601 | 9/1975 | Schaefer | 136/131 |
| 3,997,454 | 12/1976 | Adams . | |
| 4,089,790 | 5/1978 | Adams . | |
| 4,100,080 | 7/1978 | Adams . | |
| 4,100,081 | 7/1978 | Dreher et al. . | |
| 4,155,858 | 5/1979 | Adams | 252/18 |
| 4,193,882 | 3/1980 | Gemmill et al. | 252/47.5 |
| 4,517,103 | 5/1985 | Hoffman et al. . | |
| 4,584,114 | 4/1986 | Gemmill et al. | 252/47.5 |
| 4,623,474 | 11/1986 | Holstedt et al. . | |
| 4,849,118 | 7/1989 | Stauffer et al. . | |
| 5,368,758 | 11/1994 | Gapinski . | |

FOREIGN PATENT DOCUMENTS

| | | |
|---|---|---|
| 96919 | 12/1983 | European Pat. Off. . |
| 789421 | 1/1958 | United Kingdom . |

*Primary Examiner*—Prince Willis, Jr.
*Assistant Examiner*—Cephia D. Toomer
*Attorney, Agent, or Firm*—Ernest A. Schaal

[57] ABSTRACT

An antiwear additive has an alkali metal borate; and a thiadiazole compound. That thiadiazole compound may be a 2,5-dimercapto-1,3,4-thiadiazole, a 2-alkylpolythio-5-mercapto-1,3,4-thiadiazole, or a 2-alkylestermercapto-5-mercapto-1,3,4-thiadiazole. If the thiadiazole compound is a 2-alkylpolythio-5-mercapto-1,3,4-thiadiazole or a 2-alkylestermercapto-5-mercapto-1,3,4-thiadiazole, the alkyl group has from one to twenty carbon atoms. If the thiadiazole compound is a 2-alkylpolythio-5-mercapto-1,3,4-thiadiazole, the polythio group has from two to eight sulfur atoms. This antiwear additive can be used with a base grease in a grease composition.

5 Claims, No Drawings

GREASE COMPOSITION WITH IMPROVED ANTIWEAR PROPERTIES

The present invention relates to alkali metal borate antiwear additives in lubricating grease.

BACKGROUND OF THE INVENTION

Modern technology is currently supplying the general public with machinery which is designed to operate under a wider range of temperatures and under greater loads than previously available. In addition, many of the newer machines are designed to operate at extremely high speeds. Many of these machines require certain specific lubrication properties which are not available in conventional lubricants.

In the past various agents have been employed to improve the antiwear and extreme pressure properties of greases. However, while improving the extreme pressure properties of the grease many of these agents have adversely increased the corrosiveness of the grease to the metal parts which the grease is intended to protect.

Alkali-metal borate containing agents are well known in the art for their usefulness as extreme pressure agents in greases. See, for example, U.S. Pat. Nos. 4,155,858, 4,100,080 and 4,100,081, which are all hereby incorporated by reference for all purposes.

SUMMARY OF THE INVENTION

The present invention comes out of work with alkali metal borates in greases. In some applications, lubricating grease, with alkali metal borate alone, does not meet Four-Ball Wear Test requirements. We discovered that we could improve the wear performance of the grease by adding a thiadiazole compound with the alkali metal borate.

The thiadiazole compound can be 2,5-dimercapto-1,3,4-thiadiazole, a 2-alkylthio-5-mercapto-1,3,4-thiadiazole, a 2-alkylpolythio-5-mercapto-1,3,4-thiadiazole, or a 2-alkylesterthio-5-mercapto-1,3,4-thiadiazole.

If the thiadiazole compound is a 2-alkylthio-5-mercapto-1,3,4-thiadiazole, the alkyl group has from one to fourteen carbon atoms. Preferably the alkyl group of the 2-alkylpolythio-5-mercapto-1,3,4-thiadiazole has from six to ten carbon atoms.

If the thiadiazole compound is a 2-alkylpolythio-5-mercapto-1,3,4-thiadiazole, the alkyl group has from one to fourteen carbon atoms, and the polythio group has from two to eight sulfur atoms. Preferably the alkyl group of the 2-alkylpolythio-5-mercapto-1,3,4-thiadiazole has from six to ten carbon atoms and the polythio group has two sulfur atoms.

If the thiadiazole compound is a 2-alkylestermercapto-5-mercapto-1,3,4-thiadiazole, the alkylester group has from three to twenty carbon atoms. Preferably the alkyl group of the alkyl group of 2-alkylesterthio-5-mercapto-1,3,4-thiadiazole has from six to fourteen carbon atoms.

In one embodiment, a minor portion of the additive is used with a major portion of a base grease in a grease composition.

The beneficial effect that we see by using the thiadiazole compound and the alkali metal borate together is greater than the effect achieved by using either the thiadiazole compound or the alkali metal borate alone. It is also greater than the effect achieved by using the alkali metal borate with a dialkyldipolythio-1,3,4-thiadiazole.

DETAILED DESCRIPTION OF THE INVENTION

In its broadest aspect, the present invention involves the use of a thiadiazole compound with an alkali metal borate as an antiwear additive. We have discovered that this additive composition gives better results than achieved by using either the thiadiazole compound or the alkali metal borate alone.

The thiadiazole compound can be either (1) 2,5-dimercapto-1,3,4-thiadiazole; (2) a 2-alkylthio-5-mercapto-1,3,4-thiadiazole, where the alkyl group has from one to fourteen carbon atoms; (3) a 2-alkylpolythio-5-mercapto-1,3,4-thiadiazole, where the alkyl group has from one to fourteen carbon atoms, and the polythio group has from two to eight sulfur atoms or (4) a 2-alkylesterthio-5-mercapto-1,3,4-thiadiazole, where the alkyl group has from three to twenty carbon atoms.

A thiadiazole compound containing at least one mercapto group gives better antiwear results than a thiadiazole compound containing only polythio groups.

THE ALKALI METAL BORATE

The alkali-metal borates are well known in the art and are available commercially. Representative patents disclosing suitable borates and methods of manufacture include U.S. Pat. Nos.: 3,313,727: 3,819,521; 3,853,772; 3,907,601; 3,997,454; and 4,089,790, the disclosures of which are incorporated herein by reference. Preferred are the hydrated potassium borates. Particularly preferred are the hydrated potassium triborate microparticles having a boron-to-potassium ratio of about 2.5 to 4.5. The borate particles generally have a mean particle size of 1 micron.

The alkali-metal borate additive is added to the grease in an amount sufficient to impart extreme-pressure properties to the grease. The borate will generally comprise 0.1 to 10 and preferably about 0.25 to 5 mass percent of the final grease composition.

THE THIADIAZOLE COMPOUND

Thiadiazole compounds are known additives for greases. For instance, their use has been described in U.S. Pat. Nos. 4,517,103; 4,623,474; 4,849,118; and 5,368,758, which are all hereby incorporated by reference, for all purposes.

U.S. Pat. No. 4,517,103 teaches the use of a 5,5'-dithiobis (1,3,4-thiadiazole-2-thiol) as an antiwear additive in a lubricating grease. No borate is involved.

U.S. Pat. No. 4,623,474 to Holstedt et al. teaches the use of a dialkylthio-thiadiazole as a copper corrosion inhibitor with a cyclic borate of polymeric amines. The dialkylthio-thiadiazole is not used for antiwear, and the boron compound is not an alkali metal borate.

U.S. Pat. No. 4,849,118 teaches the use of a dialkylthio-thiadiazole for silver protection. No borate is involved.

U.S. Pat. No. 5,368,758 teaches the use of a salt of a 2-alkylthio-5-mercapto-1,3,4-thiadiazole. It does not teach that one sulfur group can be an alkylpolythio group. It's only mention of borates is as detergents.

These patents did not teach the beneficial effect that we see by using the thiadiazole compound and the alkali metal borate together. That beneficial effect is greater than the effect achieved by using either the thiadiazole compound or the alkali metal borate alone.

The thiadiazole compound should be either 2,5-dimercapto-1,3,4-thiadiazole, a 2-alkylpolythio-5-mercapto-1,3,4-thiadiazole, or a 2-alkylesterthio-5-mercapto-1,3,4-thiadiazole.

The compound 2,5-dimercapto-1,3,4-thiadiazole has the formula:

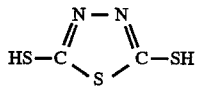

An example of 2,5-dimercapto-1,3,4-thiadiazole that is commercially available is Vanchem™ DMTD from Vanderbilt Corporation.

Both the 2-alkylthio-5-mercapto-1,3,4-thiadiazoles and 2-alkylpolythio-5-mercapto-1,3,4-thiadiazoles of the present invention can be represented by the formula:

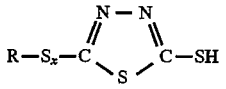

wherein the alkyl group "R" has from one to fourteen carbon atoms, and the group "$S_x$" has from one to eight sulfur atoms (x is from 1 to 8). Preferably, "R" has from six to ten carbon atoms and the polythio group has two sulfur atoms. One useful 2-alkylpolythio-5-mercapto-1,3,4-thiadiazole is 2-octyldithio-5-mercapto-1,3,4-thiadiazole, (where R has eight carbon atoms and x is 2). An example of a 2-alkylpolythio-5-mercapto-1,3,4-thiadiazole that is commercially available is Hitec™ 4312 from Ethyl Corporation.

The 2-alkylesterthio-5-mercapto-1,3,4-thiadiazole of the present invention has the formula:

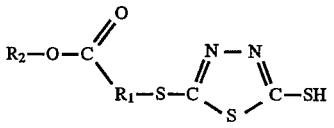

wherein "$R_1$" and "$R_2$" are alkyl groups, and the total number of carbon atoms in the alkylester group is from three to twenty, preferably six to fourteen. Either $R^1$ or $R^2$ can include one or more ester groups. An example of a 2-alkylesterthio-5-mercapto-1,3,4-thiadiazole that is commercially available is VL™ 871 from Vanderbilt Corporation.

THE GREASE

Where the lubricant is to be used in the form of a grease, a lubricating oil generally is employed in an amount sufficient to balance the total grease composition and generally, the grease compositions will contain various quantities of thickening agents and other additive components to provide desirable properties.

A wide variety of thickeners can be used in the preparation of the greases of this invention. The thickener is employed in an amount from about 0.5 to about 30 percent, and preferably from 3 to about 15 percent by weight of the total grease composition. Including among the thickeners are alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, stearin, oleic acid, palmeric acid, myristic acid, cottonseed oil acids, and hydrogenated fish oils.

Other thickeners include salt and salt-soap complexes, such as calcium stearate-acetate (U.S. Pat. No. 2,197,263), barium stearateacetate (U.S. Pat. No. 2,564,561), calcium stearate-caprylateacetate complexes (U.S. Pat. No. 2,999,066), calcium salts and soaps of low-intermediate- and high-molecular weight acids and of nut oil acids, aluminum stearate, and aluminum complex thickeners.

Particularly useful thickeners employed in the grease compositions are essentially hydrophilic in character. They have been converted into a hydrophobic condition by the introduction of long chain hydrocarbyl radicals onto the surface of the particles prior to their use as a component of a grease composition, as, for example, by being subjected to a preliminary treatment with an organic cationic surface-active agent, such as an ammonium compound. Typical ammonium compounds are tetraalkyl ammonium chlorides, such as dimethyl dioctadecyl ammonium chloride, dimethyl dibenzyl ammonium chloride and mixtures thereof. This method of conversion, being well known to those skilled in the art, is believed to require no further discussion. More specifically, the clays which are useful as starting materials in forming the thickeners to be employed in the grease compositions can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermieulite, zeolite clays and the like.

OTHER ADDITIVES

The grease composition may contain other additives, if desired, for the particular service intended. Other additives that may commonly be used include: rust inhibitors, corrosion inhibitors, metal deactivators, viscosity index improvers, antioxidants, and other additives recognized in the art to perform a particular function or functions.

EXAMPLES

The invention will be further illustrated by following examples, which set forth particularly advantageous method embodiments. While the Examples are provided to illustrate the present invention, they are not intended to limit it.

A series of tests were performed on sample compositions to measure the antiwear properties of the greases using the Four-Ball Wear test machine. The Four-Ball Wear test is a well-known standardized test and is described as ASTM D 2266 in the Annual Book of ASTM Standards, Volume 05.01, which test procedure is incorporated herein by reference. In the Four-Ball Wear test, a steel ball is rotated under load against three stationary steel balls having grease-lubricating surfaces. The diameters of the wear scars that occur on the stationary balls are measured after completion of the test. For a given load, the smaller the wear scar diameter, the better the load-carrying properties of the grease. In these tests, the base oil was a mixture of paraffinic and naphthenic mineral oils containing a lithium 12-hydroxystearate thickener. The thickener was incorporated in the composition of this invention in an amount sufficient to thicken the base vehicle to grease consistency. The greases of the present invention generally have a consistency of NLGI No. 4 to NLGI No. 000. NLGI stands for National Lubricating Grease Institute. Generally, the amount of the thickener was in the range of 3 to 15 mass percent of the final composition.

COMPARATIVE EXAMPLE A BASE GREASE ONLY

Comparative Example A consisted of only the base grease described above. The results of the Four-Ball Wear Test at a 44 Kg load was a 1.63 mm wear scar.

COMPARATIVE EXAMPLE B BASE GREASE AND ALKALI METAL BORATE ONLY

Comparative Example B consisted of the base grease described above and 0.35 weight percent of an alkali metal borate. The result of two Four-Ball Wear Tests at a 44 Kg load gave an average wear scar of 1.078 mm.

COMPARATIVE EXAMPLES C THROUGH E WITH 2,5-DIALKYLDITHIO-1,3,4-THIADIAZOLE

Comparative Example C consisted the composition of Comparative Example B, and 0.18 weight percent of Hitec™ 4313 from Ethyl Corporation (a 2,5-dialkyldithio-1,3,4-thiadiazole). The result of two Four-Ball Wear Tests at a 44 Kg load was an average 0.912 mm wear scar.

Composition D consisted of the composition of Comparative Example B and 0.27 weight percent of CUVan™ 826 from Vanderbilt Corporation (a 2,5-dialkyldithio-1,3,4-thiadiazole). The result of two Four-Ball Wear Tests at a 44 Kg load was an average 0.745 mm wear scar.

Composition E consisted of the composition of Comparative Example B and 0.20 weight percent of Vanlube 881P from Vanderbilt Corporation (a 2,5-dialkylthio-1,3,4-thiadiazole). The results of two Four-Ball Wear Tests at a 44 Kg load was an average 1.484 mm wear scar.

COMPARATIVE EXAMPLE-F WITH 5,5'-DITHIOBIS(1,3,4-THIADIAZOLE-2-THIOL)

Composition F consisted of a base grease, 0.35 weight percent of an alkali metal borate, and 0.25 weight percent of OD 911 from Vanderbilt Corporation (a 5,5'-dithiobis(1,3,4-thiadiazole-2,2'-dialkylthiol)). The results of two Four-Ball Wear Tests at a 44 Kg load was an average 0.626 mm wear scar.

COMPARATIVE EXAMPLE G BASE GREASE AND 2-ALKYLDITHIO-5-MERCAPTO-1,3,4-THIADIAZOLE ONLY

Comparative Example G consisted of the base grease described above and 0.15 weight percent of Hitec™ 4312 from Ethyl Corporation (a 2-alkyl-dithio-5-mercapto-1,3,4-thiadiazole). The results of four Four-Ball Wear Tests at a 44 Kg load was an average 1.03 mm wear scar.

EXAMPLE I WITH 2,5-DIMERCAPTO-1,3,4-THIADIAZOLE

Example I consisted of the composition of Comparative Example B and 0.06 weight percent of Vanchem™ DMTD from Vanderbilt Corporation (2,5-dimercapto-1,3,4-thiadiazole). The results of two Four-Ball Wear Tests at a 44 Kg load was an average 0.518 mm wear scar.

EXAMPLE II WITH 2-ALKYLDITHIO-5-MERCAPTO-1,3,4-THIADIAZOLE

Example II consisted of the composition of Comparative Example B and 0.15 weight percent of Hitec™ 4312 from Ethyl Corporation (a 2-alkyl-dithio-5-mercapto-1,3,4-thiadiazole). The results of two Four-Ball Wear Tests at a 44 Kg load was an average 0.540 mm wear scar.

EXAMPLE III WITH 2-ALKYLESTERTHIO-5-MERCAPTO-1,3,4-THIADIAZOLE

Example III consisted of the composition of Comparative Example B and 0.21 weight percent of VL™ 871 from Vanderbilt Corporation, a 2-alkylesterthio-5-mercapto-1,3,4-thiadiazole. The results of two Four-Ball Wear Tests at a 44 Kg load was an average 0.528 mm wear scar.

| Run | Compartive Examples Components | Average Wear scar, mm |
|---|---|---|
| A | Base grease only | 1.63 |
| B | Base grease and alkali metal borate only | 1.078 |
| C | With 2,5-dialkyldithio-1,3,4-thiadiazole | 0.912 |
| D | With 2,5-dialkyldithio-1,3,4-thiadiazole | 0.745 |
| E | With 2,5-dialkyldithio-1,3,4-thiadiazole | 1.484 |
| F | With 5,5'-dithiobis(1,3,4-thiadiazole-2,2'-dialkylthiol) | 0.626 |
| G | Base grease and 2-alkyldithio-5-mercapto-1,3,4-thiadiazole only | 1.03 |

| Run | Examples of the Invention Components | Wear scar, mm |
|---|---|---|
| I | With 2,5-dimercapto-1,3,4-thiadiazole | 0.518 |
| II | With 2-alkyldithio-5-mercapto-1,3,4-thiadiazole | 0.540 |
| III | with 2-alkylesterthio -5-mercapto-1,3,4-thiadiazole | 0.528 |

These examples show that the beneficial effect that we see by using the thiadiazole compound and the alkali metal borate together is greater than the effect achieved by using the thiadiazole compound or the alkali metal borate alone. That beneficial effect is also greater than the effect achieved by using the alkali metal borate with a dialkylpolythio-1,3,4-thiadiazole.

While the present invention has been described with reference to specific embodiments, this application is intended to cover those various changes and substitutions that may be made by those skilled in the art without departing from the spirit and scope of the appended claims.

What is claimed is:

1. An additive comprising:

(a) an alkali metal borate; and (b) a thiadiazole compound selected from the group consisting of:

(1) 2,5-dimercapto-1,3,4-thiadiazole;

(2) 2-alkylthio-5-mercapto-1,3,4-thiadiazole, wherein the alkyl group has from one to fourteen carbon atoms;

(3) 2-alkylpolythio-5-mercapto-1,3,4-thiadiazole, wherein the alkyl group has from one to fourteen carbon atoms, and the polythio group has from two to eight sulfur atoms; and (4) 2-alkylestermercapto-5-mercapto-1,3,4-thiadiazole, wherein the alkyl group has from three to twenty carbon atoms.

2. An additive according to claim 1 wherein the thiadiazole compound is 2-alkylpolythio-5-mercapto-1,3,4-thiadiazole, and wherein the alkyl group of the 2-alkylpolythio-5-mercapto-1,3,4-thiadiazole has from six to ten carbon atoms.

3. An additive according to claim 2 wherein the polythio group has two sulfur atoms.

4. An additive according to claim 1 wherein the thiadiazole compound is 2-alkylestermercapto-5-mercapto-1,3,4-thiadiazole, and wherein the alkylester group of 2-alkylestermercapto-5-mercapto-1,3,4-thiadiazole has from six to twenty carbon atoms.

5. A grease composition comprising:

(a) a major portion of a base grease, and (b) a minor portion of an additive according to claim 1.

* * * * *